United States Patent [19]

Burroughs et al.

[11] Patent Number: 4,537,128

[45] Date of Patent: Aug. 27, 1985

[54] HAND PRINTER DESIGNED TO ENABLE A HANDICAPPED PERSON TO APPLY A SIGNATURE TO A DOCUMENT

[75] Inventors: Robert H. Burroughs, Brookline, Mass.; John D. Wright, Sandown, N.H.; Jeffrey A. Secunda, Sharon; Ronald S. Newbower, Acton, both of Mass.

[73] Assignee: Massachusetts General Hospital, Boston, Mass.

[21] Appl. No.: 543,609

[22] Filed: Oct. 20, 1983

[51] Int. Cl.[3] ..... B41K 1/00; B41K 1/48; B41F 1/28

[52] U.S. Cl. ..... 101/407 BP; 101/102; 101/287; 101/327; 101/332; 101/336; 101/368; 101/405

[58] Field of Search ..... D18/14, 15, 22; D11/2; 63/1, 15; 144/3 N, 358; 248/441, 442, 442.2; 101/368, 407 R, 407 BP, 336, 405, 287, 102, 327, 332

[56] References Cited

U.S. PATENT DOCUMENTS

| | | | |
|---|---|---|---|
| D. 216,413 | 12/1969 | Horii | D18/22 |
| 480,314 | 8/1892 | Beerbower | 400/97 |
| 632,266 | 9/1899 | Housh | 101/407 BP |
| 759,818 | 5/1904 | Marriott | 400/48 |
| 1,295,325 | 2/1919 | Johnson | 101/368 |
| 1,372,501 | 3/1921 | Gray | 101/287 |
| 1,594,785 | 9/1926 | Lindburg | 400/521 |
| 1,634,105 | 6/1927 | Hoffman | 101/20 |
| 1,716,036 | 6/1929 | Dunning | 101/368 X |
| 1,815,026 | 7/1931 | Green | 400/205 |
| 2,102,771 | 12/1937 | Watkins | 101/287 |
| 2,116,568 | 5/1938 | Gates | 101/127.1 |
| 2,185,811 | 1/1940 | Heyman | 101/22 |
| 3,057,291 | 10/1962 | Smith | 101/407 BP |
| 3,290,061 | 12/1966 | Glassman | 101/369 |
| 3,403,623 | 10/1968 | Blackwood | 101/368 |
| 3,486,752 | 12/1969 | Colvin | 101/368 X |
| 3,596,055 | 7/1971 | Elston | 400/120 X |
| 3,756,153 | 9/1973 | Cohen | 101/368 |
| 3,768,947 | 10/1973 | Dunejer | 63/1 X |
| 3,916,788 | 11/1975 | Rodriguez | 400/199 X |
| 4,077,323 | 3/1978 | Liuzzo | 101/407 R |

FOREIGN PATENT DOCUMENTS

| | | | |
|---|---|---|---|
| 95364 | 12/1923 | Austria | 101/405 |
| 71751 | 11/1950 | Denmark | 101/368 |
| 2062085 | 6/1971 | France | 400/120 |

OTHER PUBLICATIONS

Laybourn, Display/Audit Printer, Apr. 1976, vol. 18, No. 11, pp. 3800–3801.

*Primary Examiner*—Clyde L. Coughenour
*Assistant Examiner*—William L. Klima
*Attorney, Agent, or Firm*—David G. Conlin; Robert T. Gammons

[57] ABSTRACT

A system designed to enable persons incapable of manipulating a writing implement to sign papers and/or documents comprising a holder for the document to be signed, a holder for a transfer sheet for holding the transfer sheet adjacent that portion of the document to be signed and an implement defining the signature to be applied to the document for pressing the transfer sheet into transferring engagement with the document.

3 Claims, 7 Drawing Figures

HAND PRINTER DESIGNED TO ENABLE A HANDICAPPED PERSON TO APPLY A SIGNATURE TO A DOCUMENT

BACKGROUND OF INVENTION

Embossing devices, rubber stamps and ink pads and the like have been used for years to apply signatures or marks representing authorized signatures to papers and documents. However, many persons who are motion-impaired and/or unable to ascertain simple instructions because of birth defects or disabling disease are incapable of manipulating a writing implement for the purpose of signing a paper or document and/or signing a paper or document in the proper place. It is the purpose of this invention to provide means which will not only enable an incapacitated person to apply his signature to a paper or document, but also to apply it in the proper place.

SUMMARY OF INVENTION

As herein illustrated, the system of this invention for applying a signature to a document by the simple expedient of applying pressure without manipulation comprises a holder for receiving the document to be signed with the back side rigidly supported and with that portion of its face to which the signature is to be applied exposed, means associated with the holder for supporting a transfer sheet with a portion thereof adjacent the exposed portion of the document to which the signature is to be applied and means defining the signature to be applied for pressing the transfer sheet into transferring engagement with the exposed portion of the document. The transfer sheet embodies a transfer surface bearing a transfer material transferable by application of pressure and/or heat and, desirably, the transfer material is indelible. Means defining the signature to be applied for pressing the transfer sheet into engagement with the exposed portion of the document may comprise an implement bearing an embossment which may be held and pressed against the transfer sheet or a finger ring bearing the embossment of the signature which may be used to press the transfer sheet against the document. The holder defines a substantially rectangular recess having a rigid, planar bottom surface bounded on three sides by a shoulder open at the top and open at one end and of a depth to receive the document to be signed by inserting the latter into the recess from the open end. Desirably, the recess is of a length and breadth corresponding to the length and breadth of the document and of a thickness corresponding substantially to the thickness of the document and the means associated with the holder for supporting the transfer sheet contains a slot for receiving the transfer sheet and for holding the latter in parallel relation to the document and is provided with openings in registration with that portion of the document which is to be signed through which the implement can be inserted to press the transferring surface of the transfer sheet into engagement with the document. Desirably, the means for supporting the transfer sheet is a second holder coextensive with the first holder adapted to be placed on the shoulder of the first holder containing a downwardly-open recess in the area where the signature is to be applied to the document and a retaining member at the open side of the recess for holding the transfer sheet within the recess.

The invention will now be described in greater detail with reference to the accompanying drawings, wherein.

Figure 1:
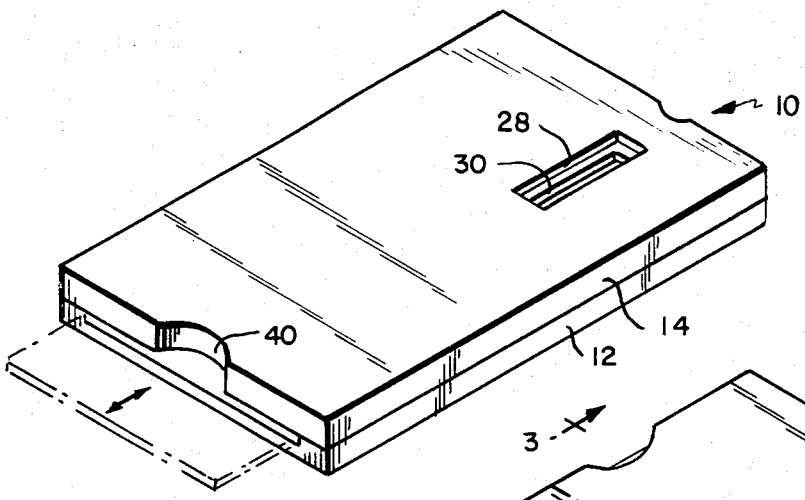
FIG. 1 is a perspective view of the holder as viewed from one end.
Figure 2:
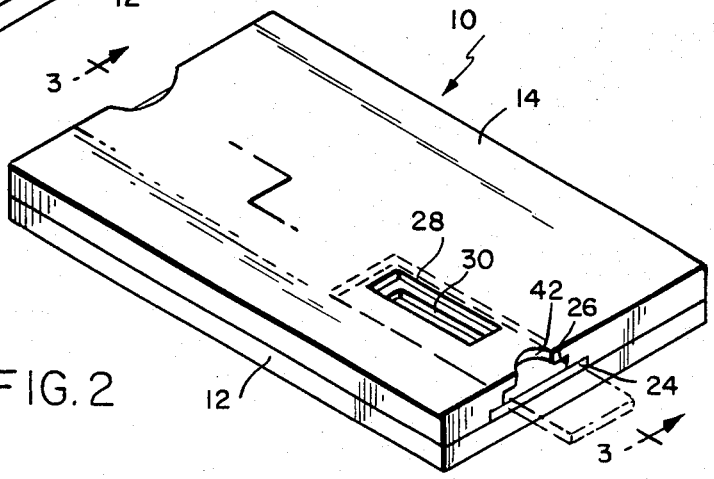
FIG. 2 is a perspective view of the holder as viewed from one side.
Figure 3:
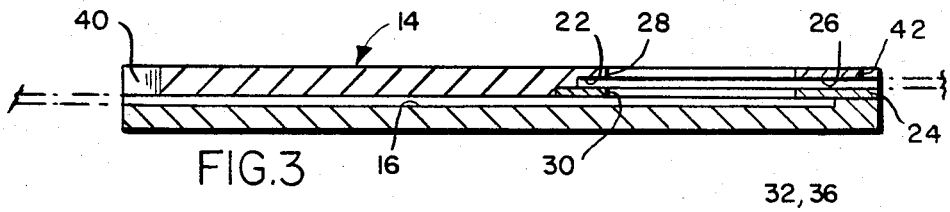
FIG. 3 is a section taken on the line 3—3 of FIG. 2.
Figure 4:
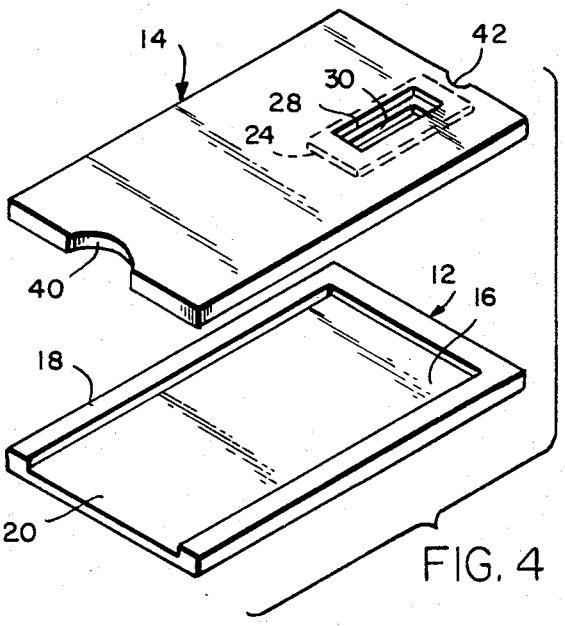
FIG. 4 is an exploded perspective of the two parts of the holder.
Figure 5:
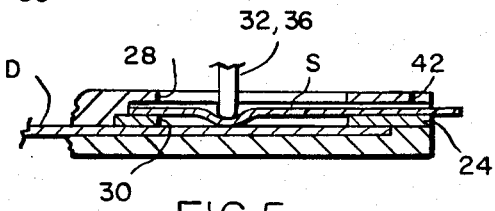
FIG. 5 is a fragmentary section showing the application of a signature to a document.

Referring to the drawings, there is shown an assembly 10 comprising a bottom part 12 and a top part 14, each of which is of generally rectangular configuration. The bottom part 12 contains a substantially rectangular recess 16 bounded on two of its parallel sides and one end by an upstanding shoulder 18 and open at the other end. The recess is of substantially the length, breadth and depth of the papers or documents to be signed. The open end 20 of the recess provides for sliding the document D into the recess. The bottom of the recess is a uniformly-flat, planar surface and of a rigidity to provide an unyielding backing for a document resting in the recess.

The top part 14 is of substantially the same rectangular configuration as the bottom part and is coextensive in length and breadth therewith and contains a downwardly-open recess 22 located in an area thereof such as to be in registration with that portion of the area of the document to be signed. The configuration of the recess is unimportant so long as it is of sufficient area to embrace the signature to be applied to the document. The open side of the recess 22 is closed by a retaining plate 24 fixed in the recess parallel to the bottom thereof which defines with the bottom a slot 26 parallel to the bottom surface of the recess 16. An opening 28 is provided in the part 14 and an opening 30 in the retaining plate 24. These openings 28 and 30 are in registration with each other and are in registration with the area of the document which is to be signed. The slot 26 provides for supporting a flexible transfer sheet S bearing a transfer material on one surface in a position parallel to the recess 16 and, hence, to the surface of the document to be signed.

Figure 6:
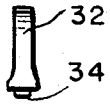
FIG. 6 is an elevation of a signature-bearing implement for applying a signature.
Figure 7:
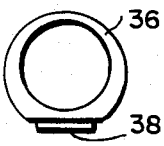
FIG. 7 is an elevation of a signature-bearing ring for applying a signature.

For the purpose of pressing the transfer sheet against the surface of the document, there is provided, as shown in FIGS. 6 and 7, an implement in the form of a tool 32 bearing indicia 34 representing the signature to be applied to the document, or a finger ring 36 bearing indicia 38 corresponding to the signature to be applied. With the use of either the tool or the finger ring, the embossment 34 or 38 can be pressed through the opening 28 into engagement with the back side of the transfer sheet S and, in turn, to press the transfer sheet through the opening 30 into engagement with the surface of the paper or document in the recess 16 to effect transfer of the transferable material to the document.

The transfer sheet may have on it a transferable material transferable by pressure and/or heat and, desirably, the material is indelible.

To enable easily inserting and removing the papers or documents which are to be signed, there is provided at the left end of the assembly, as shown in FIG. 1, in the upper part 14 a recess 40 which enables grasping the end of the paper or document after it has been signed to facilitate its removal. A corresponding recess 42 is provided in the part 14 at an end of the slot 26 to enable removing the transfer sheet either to provide a fresh sheet for a sheet which has been used up or to replace it with a transfer sheet bearing a different color and/or a different kind of transferable material.

The location of the slot 26 will be selected according to the particular position that the documents are to be signed and while only one relatively narrow recess is shown herein, the recess could, of course, be enlarged longitudinally and transversely of the assembly to enable applying signatures to one or more areas or several separate recesses could be incorporated in the part 14 to enable not only applying signatures, but dates and other identifying media.

The device as thus described is of very simple inexpensive construction; however, it enables seriously handicapped persons to engage in productive pursuits of a simple nature which require, for example, signatures or identification and, further, a device which enables them personally to sign, for example, checks or documents without always requiring the aid of a second person.

It should be understood that the present disclosure is for the purpose of illustration only and includes all modifications or improvements which fall within the scope of the appended claims.

What is claimed is:

1. Structure designed to enable a handicapped person to apply his signature or other identifying mark to a predetermined area of a document with the aid of a finger ring bearing an embossment of the signature or other identifying mark of the person, comprising, in combination, a holder for receiving the document and a finger ring bearing the signature or other identifying mark of the person, said holder embodying a bottom part defining a substantially rectangular recess of such area and depth as to receive the document to be signed, said recess being open at one end to enable inserting a document therein and closed at the other, a top part coextensive in area with the bottom part containing substantially rectangular openings, one above the other, in the area thereof above the area of the document to be signed, so positioned relative to the closed end of the recess of the bottom part that when a document is inserted into the recess in the bottom part between the parts in engagement with the closed end of the recess in the bottom part, the area of the document to be signed will be aligned with the upper one of said openings in the top part, the lower one of the openings in the top part being larger in area than the upper one of the openings and said lower one of said openings being closed at the end proximate the open end of the recess in the bottom part and open at the end remote therefrom for receiving transfer paper, a retainer plate constituting a spacer recessed into the top part below the lower one of the openings therein, said spacer defining an opening corresponding in area to the area of the upper one of the openings in the top part and being centered with respect thereto, said spacer further defining a supporting surface for supporting the transfer sheet in spaced, parallel relation to the document in the recess in the bottom part, said upper one of the openings in the top part and the opening in the spacer being of an area commensurate with the signature or other identifying mark to be applied to the document situated in the recess in the bottom part, said openings being of a size to enable inserting the embossment of the signature bearing ring through the openings in the top part and the opening in the spacer into engagement with the transfer sheet located in the recess in the bottom part and arcuate reentrant notches at the opposite ends of the top part centered on the longitudinal center lines of the recess in the bottom part and the openings in the top part providing access to the document located in the recess in the bottom part and access to the transfer sheet located in the lower one of the openings in the top part.

2. The combination according to claim 1 wherein the transfer sheet embodies a transfer surface bearing a transferable material transferable by an application of pressure.

3. The combination according to claim 1 wherein the transfer sheet embodies a transfer surface bearing an indelible transferable material transferable by application of pressure.

* * * * *